US006020780A

United States Patent [19]

Ozeki

[11] Patent Number: 6,020,780

[45] **Date of Patent: *Feb. 1, 2000**

[54] SUBSTRATE POTENTIAL CONTROL CIRCUIT CAPABLE OF MAKING A SUBSTRATE POTENTIAL CHANGE IN RESPONSE TO A POWER-SUPPLY VOLTAGE

[75] Inventor: Seiji Ozeki, Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/834,036

[22] Filed: Apr. 11, 1997

[30] Foreign Application Priority Data

Apr. 15, 1996 [JP] Japan ..... 8-092144

[51] Int. Cl.[7] ..... G05F 1/10

[52] U.S. Cl. ..... 327/540; 327/536; 327/538; 327/543

[58] Field of Search ..... 327/534, 535, 327/536, 537, 538, 540, 541, 543; 363/59, 60

[56] References Cited

U.S. PATENT DOCUMENTS 5,034,625 7/1991 Min et al. ..... 327/536
5,396,114 3/1995 Lee et al. ..... 327/535
5,506,540 4/1996 Sakurai et al. ..... 327/535
5,629,646 5/1997 Menezes et al. ..... 327/535

FOREIGN PATENT DOCUMENTS 438791 2/1992 Japan ..... G11C 11/407
5-205468 8/1993 Japan ..... G11C 11/407
8-329674 12/1996 Japan ..... G11C 11/403

*Primary Examiner*—Jung Ho Kim
*Attorney, Agent, or Firm*—Hayes Soloway Hennessey Grossman & Hage PC

[57] ABSTRACT

In a substrate potential control circuit, first and second substrate potential detection circuits have different intersected characteristics of Vcc versus $V_{SUB}$ detection level and produce, in response to a substrate potential $V_{SUB}$, first and second substrate potential detection signals SUBUP1 and SUBUP2, respectively. A composition circuit composes the first and the second substrate potential detection signals SUBUP1 and SUBUP2 to produce a composite substrate potential detection signal SUBUP. Responsive to the composite substrate potential detection signal SUBUP, a back bias generation circuit generates a back bias signal BBG. Responsive to the back bias signal BBG, a pumping circuit makes the substrate potential $V_{SUB}$ by pumping.

13 Claims, 10 Drawing Sheets

FIG.9A
PRIOR ART
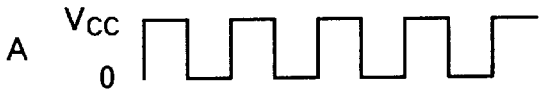
FIG.9B
PRIOR ART
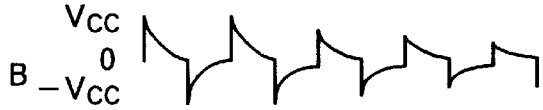
FIG.9C
PRIOR ART
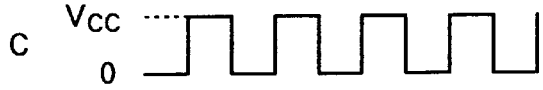
FIG.9D
PRIOR ART
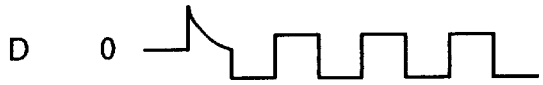
FIG.9E
PRIOR ART
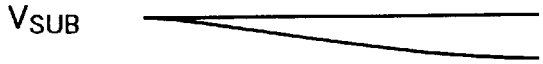
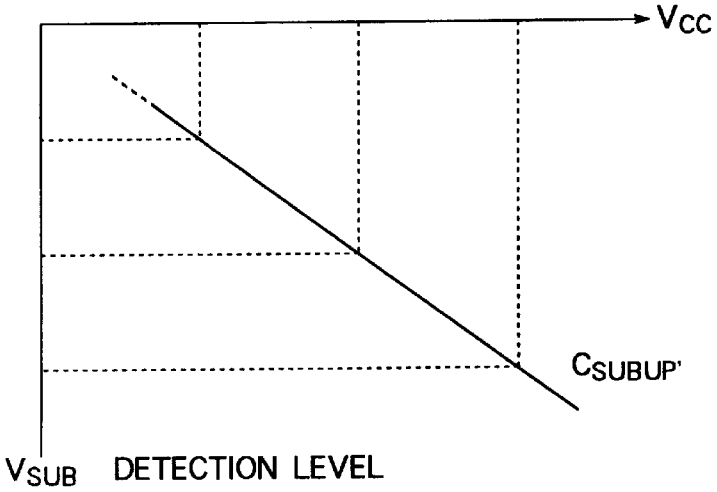
FIG. 10 PRIOR ART

SUBSTRATE POTENTIAL CONTROL CIRCUIT CAPABLE OF MAKING A SUBSTRATE POTENTIAL CHANGE IN RESPONSE TO A POWER-SUPPLY VOLTAGE

BACKGROUND OF THE INVENTION

This invention relates to a semiconductor integrated circuit device and, more particularly, to a substrate potential control circuit for use in the semiconductor integrated circuit device.

With high integration in a semiconductor integrated circuit device, it is necessary for a sense amplifier used therein to detect a minute potential difference between digit lines. More specifically, in order to make the integration high, a cell of one-transistor and one-capacitor type is used as a memory cell for use in a current typical dynamic random access memory (which is abbreviated to DRAM hereinunder). As is well known in the art, the cell of one-transistor and one-capacitor type comprises two elements, a capacitor element for accumulating electric charges and a metal oxide semiconductor field effect transistor (MOSFET) for controlling input/output of the electric charges. With high integration, the capacitor element necessarily has a small capacitance value and, consequently can only charge a small amount. Accordingly, a sense amplifier, which is for detecting the presence of absence of the electric charges accumulated in the capacitor element, must detect a potential difference (which is also called a difference potential) defined by the trace of electric charges which are accumulated in the capacitor element. For instance, in the DRAM having storage capacity of four Mbits, the above-mentioned potential difference is about 200 millivolts (or, a very minute amount).

As a result, it is difficult to detect the difference potential in operation, part due to soft error, variation of power-supply voltage, or the like, which could result in data being destroyed. Accordingly, a recent development is to employ a sense amplifier with a dummy word. The sense amplifier of this type operates by making the difference potential large by coming down due to capacitive coupling a level of one of the digit lines that acts as a basis on sense operation.

As described below, it is necessary for the memory cell to control a threshold voltage of the MOSFET. To control the threshold voltage, a substrate potential may be controlled, because the threshold voltage is defined by the substrate potential. Known substrate potential control circuits are for controlling the substrate potential to make the threshold voltage constant. By way of example, Japanese Unexamined Patent Publication of Tokkai No. Hei 4-38,791 or JPA 4-38,791 discloses a semiconductor device which is capable of maintaining the substrate potential at a set voltage in spite of variation of an external power-supply voltage. That is, the JPA 4-38,791 makes an internal voltage having less dependence on the external power-supply voltage, and produces, on the basis of the internal voltage and an actual substrate potential, a substrate potential detection signal. As a result, it is impossible to the JPA 4-38,791 to change the substrate potential in response to the power-supply voltage. This is because the substrate potential is maintained constant although the power-supply voltage varies.

A conventional substrate potential control circuit, which can make the substrate potential change in response to the power-supply voltage, is known. The substrate potential control circuit comprises a substrate potential detection circuit, a back bias generation circuit, and a pumping circuit. The substrate potential detection circuit detects the substrate potential to produce a substrate potential detection signal. Responsive to the substrate potential detection signal, the back bias generation circuit generates a back bias signal. Responsive to the back bias signal, the pumping circuit carries out a pumping operation to make an absolute value of the substrate potential larger. The combination of the back bias generation circuit and the pumping circuit serves as a substrate potential generation circuit for generating the substrate potential in response to the substrate potential detection signal.

However, the conventional substrate potential control circuit cannot control so as to make the absolute value of the substrate potential smaller when the power-supply voltage has a minimum level, and to maintain the substrate potential when the power-supply voltage has a maximum level. Primarily because the connection between the power-supply voltage and a substrate potential detection level is approximately linear in the conventional substrate potential control circuit.

SUMMARY OF THE INVENTION

Accordinaly, the present invention provides a substrate potential control circuit in which connection between a power-supply voltage and a substrate potential detection level is nonlinear.

Other objects of this invention will become clear as the description proceeds.

In one aspect of the present invention, a semiconductor integrated circuit device is provided comprising a substrate potential detection section and a substrate potential generation circuit. Supplied with a power-supply voltage, the substrate potential detection section detects a substrate potential to produce a substrate potential detection signal. The substrate potential generation circuit generates the substrate potential in response to the substrate potential detection signal.

Preferably, the substrate potential detection section comprises a plurality of different potential detection circuits having different power-supply voltage versus substrate potential characteristics for generating a plurality of different substrate detection signals a composition circuit for composing the plurality of different substrate detection signals to generate a composite substrate potential detection signal.

BRIEF DESCRIPTION OF THE DRAWING

FIGS. 9A through 9E are time charts for use in describing operation of the pumping circuit illustrate in FIG. 8;

FIG. 10 shows a characteristic of Vcc versus $V_{SUB}$ detection level in the conventional substrate potential control circuit illustrated in FIG. 5;

DESCRIPTION OF THE PREFERRED EMBODIMENTS

Figure 1:
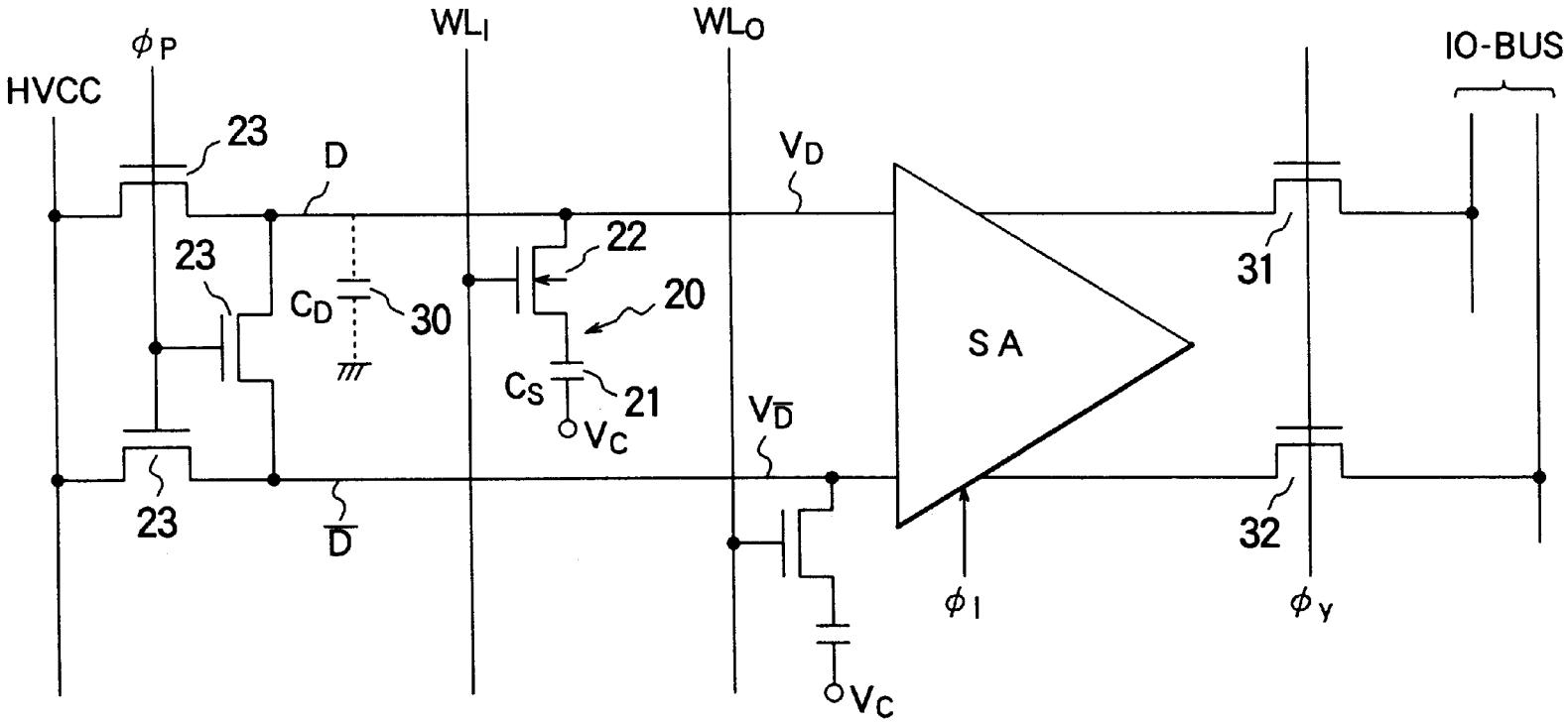
FIG. 1 PRIOR ART
FIG. 1 is a block diagram of a sense amplifier of a dummy word type, together with a memory cell.

Referring to FIG. 1, a sense amplifier of a dummy word type will be described to facilitate an understanding the present invention. The illustrated sense amplifier SA is a circuit for sensing and amplifying a minute output signal in a memory cell 20 which is connected to a word line $WL_1$ and a digit line D. The digit line D is called a bit line. The illustrated memory cell 20 comprises a capacitor element 21 having a capacitance value of $C_s$ and an N-channel MOSFET 22. The N-channel MOSFET 22 has a gate electrode connected to the word line $WL_1$, a drain electrode connected to the digit line D, and a source electrode connected to an end of the capacitor element 21. The capacitor element 21 has another end which is supplied with a constant voltage Vc.

The sense amplifier SA is connected to the digit line D, and an inverted digit line $\overline{D}$ and senses a potential difference ΔV between a pair of the digit lines D and $\overline{D}$. Herein, it is assumed that the digit lines D and $\overline{D}$ have parasitic capacitors having a capacitance value of $C_D$ and that a parasitic capacitor element 30 is equivalently connected to the digit line D. In general, a ratio $C_D/C_S$ of the capacitance value $C_D$ of the parasitic capacitor element 30 and the capacitance value $C_S$ of the capacitor element 21 is about ten and a capacitance of the memory cell 20 is very small. The sense amplifier SA has output terminals which are connected to input/output buses IO-Bus via a pair of MOSFETs 31 and 32. The pair of MOSFETs are controlled by a clock signal $\Phi_y$.

Figure 2:
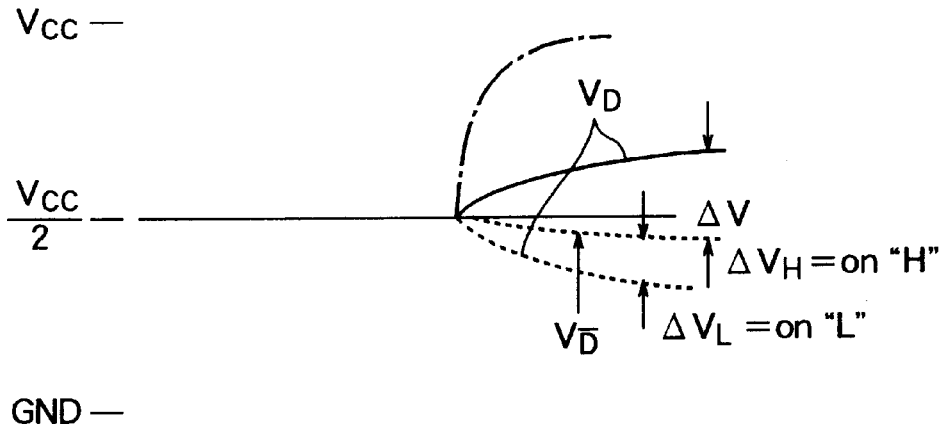
FIG. 2 PRIOR ART
FIG. 2 is a time chart for use in describing operation of the sense amplifier illustrated in FIG. 1.

Referring to FIG. 2, in addition to FIG. 1, the description will be made as regards operation on reading data from the memory cell 20. In FIG. 1, the pair of digit lines D and $\overline{D}$ are precharged to a voltage (Vcc/2) by a voltage HVCC with a precharge clock signal $\Phi_P$ put into a logical high level of "H". The voltage HVCC is produced by a (Vcc/2) generating circuit (not shown) and always holds a level of (Vcc/2).

When the precharge clock signal $\Phi_P$ turns from the logical level of "H" to a logical level of "L", N-channel MOSFETs 23 turn off, and the pair of digit lines D and $\overline{D}$ are put into a floating state at the level of (Vcc/2).

Thereafter, the work line $WL_1$ has a potential $V_{WL1}$ which turns from the logical level of "L" to the logical level of "H" and the N-channel MOSFET 22 is put into a conduction state. As a result, electric charges from the capacitor element 21 appear at the digit line D which results in producing a potential difference ΔV between the pair of the digit lines D and $\overline{D}$. The potential difference ΔV is produced with the electric charges in the capacitor element 21 distributed between the wiring capacitor 30 and the capacitor element 21 and has about 200 mV. Theoretically, the potential difference ΔV when the capacitor element 21 has the logical level of "H", or the level of the power-supply voltage Vcc, is equal to the potential difference ΔV when the capacitor element 21 has the logical level of "L", or the level of the ground. However, inasmuch as the digit line (herein the inverted digit line $\overline{D}$) has a level less than (Vcc/2) line (not shown) before the potential $V_{WL1}$ of the word line $WL_1$ is raised, the potential differences on the logical level of "H" and "L" are depicted at $\Delta V_L$ and $\Delta V_H$, respectively, as shown in FIG. 2 and the potential difference $\Delta V_H$ on the logical level "H" is higher than the potential difference $\Delta V_L$ on the logical level "L".

This is due to the degradation of sense margin due to soft errors, variation of the power source voltage, or the line when the memory cell 20 has the logical level of "H". The sense amplifier SA senses the potential difference ΔV and carries out amplification operation.

Figure 3:
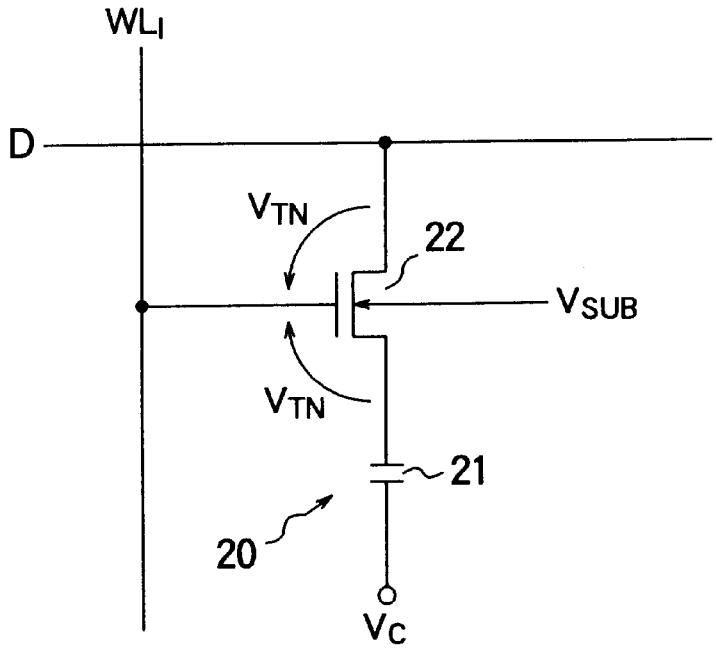
FIG. 3 PRIOR ART
FIG. 3 is a circuit diagram of an enlarged memory cell illustrated in FIG. 1.
Figure 4A:
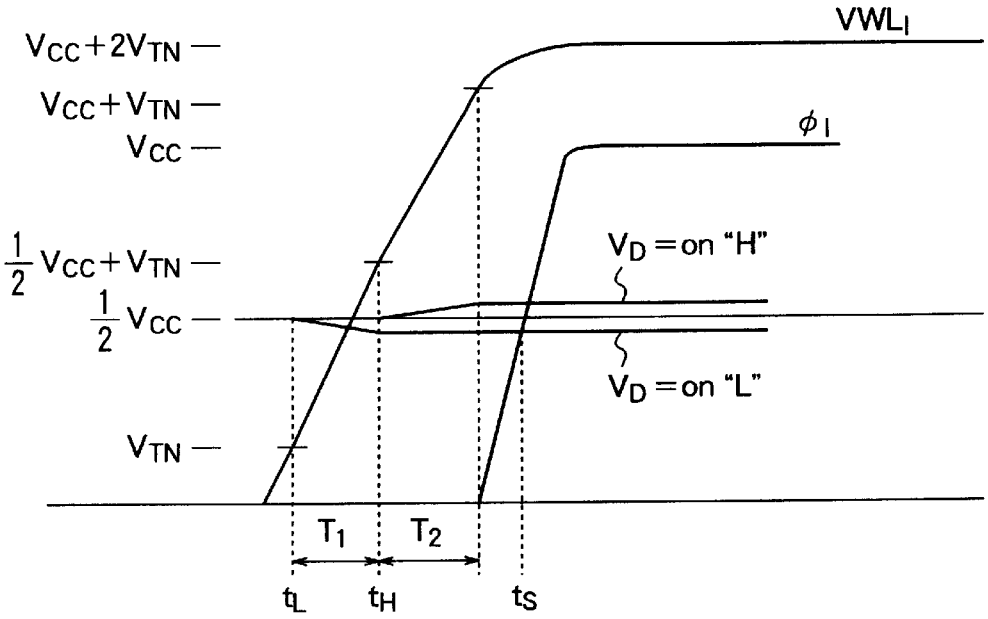
FIG. 4A PRIOR ART
FIGS. 4A and 4B are time charts for use in describing operation of the sense amplifier illustrated in FIG. 1 in detail.
Figure 4B:
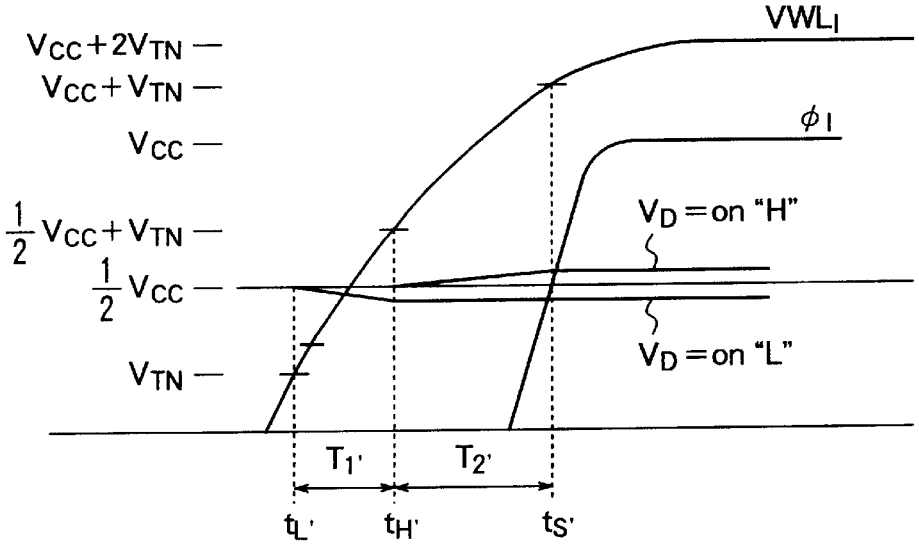
FIG. 4B PRIOR ART

Referring to FIG. 3 and FIGS. 4A and 4B, the operation of starting the sensing is discribed. FIG. 4A shows a time chart when the power-supply voltage Vcc has a normal level. FIG. 4B shows another time chart when the power source voltage Vcc has a minimum level.

As shown in FIG. 3, the N-channel MOSFET 22 has a threshold voltage $V_{TN}$. As a result, the N-channel MOSFET 22 does not conduct unless a voltage between source and gate electrodes in the N-channel MOSFET 22 is not less than the the threshold voltage $V_{TN}$. It is assumed that the charges corresponding to the logical level of "H" are accumulated in the capacitor element 21. In this event, the N-channel MOSFET 22 starts to conduct when the voltage $V_{WL1}$ of the word line $WL_1$ is higher than the voltage of $(Vcc/2+V_{TN})$, the electric charges appear on the digit line D, and then the potential of the digit line D arises. On the other hand, it is assumed that the charges corresponding to the logical level of "L" are accumulated in the capacitor element 21. In this event, the N-channel MOSFET 22 starts to conduct when the voltage $V_{WL1}$ of the word line $WL_1$ is higher than the voltage of $V_{TN}$, the electric charges appear on the digit line D, and then the potential of the digit line D drops.

It is presumed that the power-supply voltage Vcc has the normal level as shown in FIG. 4A. In this event, there is a time difference $\tau_1$ between a time instant $t_H$, where the electric charges appear on the digit line D when the memory cell 20 takes the logical level of "H", and a time instant $t_L$, where the electric charges appear on the digit line D when the memory cell 20 takes the logical level of "L".

A sense amplifier drive signal $\Phi_1$ (FIG. 1) rises when a constant time interval has elapsed, since the potential $V_{WL1}$ of the word line $WL_1$ starts to rise. Responsive to the sense amplifier drive signal $\Phi_1$, the sense amplifier SA senses the potential difference ΔV and starts to amplify. Unless the potential differences $\Delta V_H$ and $\Delta V_L$ have a desired value until a time instant $t_S$, the sense operation is not sufficiently carried out.

In the situation shown in FIG. 4A, there is not a problem. This is because prior to the time instant $t_S$, transmission of the logical level of "H" from the memory cell 20 to the digit line D completes at a time instant at which a time interval $\tau_2$ has elapsed since the time instant $t_H$, It is presumed that the power source voltage Vcc has the minimum level as shown in FIG. 4B. In this event, it seems that the threshold voltage $V_{TN}$ of the N-channel MOSFET 22 relatively enlarges with respect to the power-supply voltage Vcc. The lower the power-supply voltage Vcc becomes, the more this becomes significant. In addition, inasmuch as operation of a voltage boosting circuit (not shown) for supplying the word line $WL_1$ with the potential $V_{WL1}$ becomes slow, a transition from the logical level of "L" to the logical level of "H" in the potential $V_{WL1}$ of the word line $WL_1$ becomes less steep.

Accordingly, a time instant $t_H'$ where the electric charges appear on the digit line D when the memory cell 20 takes the logical level of "H" is delayed by a time interval $\tau_1'$ after a time instant $t_L'$ where the charges appear on the digit line D when memory cell 20 takes the logical level of "L". A completion of transmission to the digit line D is delayed until a time instant where a time interval $\tau_2'$ has elapsed (since the time instant $t_H'$) and may be later than a time instant $t_S'$. Accordingly, if the worst happens, the time instant of the time instant $t_H'$ plus the time interval $\tau_2'$ is later than the time instant $t_S'$. Under these circumstances, the operation margin of the sense amplifier SA deteriorates and it is unable to amplify. That is, it is impossible to sense when the memory cell 20 takes the logical level of "H", and operation of memory cannot be correctly carried out when the power-supply voltage Vcc has a minimum level.

A means to solve the above-mentioned problem is to make a time interval between the time instants $t_H$ and $t_S$ longer. For this purpose, the time interval between the time instant where the potential $V_{WL1}$ of the word line $WL_1$ is raised and the time instant where the sense amplifier drive signal $\Phi_1$ is raised must be made sufficiently longer. In other words, this means that the time instant where the sense amplifier drive signal $\Phi_1$ is raised must be made later. However, to make the time instant where the sense amplifier drive signal $\Phi_1$ later results in being late a time instant where the sense operation comes to end. As a result, readout operation of the memory cell 20 becomes slow, causing degradation of performance.

Another means to solve the above-mentioned problem is to make the threshold voltage $V_{TN}$ of the N-channel MOSFET 22 lower. The lower the threshold voltage $V_{TN}$ becomes, the earlier time instants where the electric charges start or end transfer to the digit line D when the memory cell 20 takes the logical level of "H". In addition, the operation of the sense amplifier SA becomes faster because the capability of the transistor improves. As a result, the margin of the sense operation extends.

That is, it is necessary to control the threshold voltage $V_{TN}$ of the N-channel MOSFET 22. The threshold voltage $V_{TN}$ is defined by a substrate potential $V_{SUB}$ depicted in FIG. 3. In the present invention, an absolute value of the substrate potential $V_{SUB}$ is made larger to make the substrate potential $V_{SUB}$ deeper. In addition, the absolute value of the substrate potential $V_{SUB}$ is made smaller to make the substrate potential $V_{SUB}$ shallower. When the substrate potential $V_{SUB}$ is made deeper, the threshold voltage $V_{TN}$ shifts in a direction to become higher. When the substrate potential $V_{SUB}$ is made shallower, the threshold voltage $V_{TN}$ shifts in a direction to become lower.

Various substrate potential control circuits for controlling the substrate potential $V_{SUB}$ are transitionally proposed. There are known substrate potential control circuits is for controlling the substrate potential $V_{SUB}$ so as to make the threshold voltage $V_{TN}$ constant. By way of example, Japanese Unexamined Patent Publication of Tokkai No. Hei 4-38,791 or JPA 4-38,791 discloses a semiconductor device which is capable of maintaining the substrate potential at a set voltage in spite of variation of an external power-supply voltage. That is, the JPA 4-38,791 makes an internal voltage having less dependence on the external power-supply voltage produce and produces, on the basis of the internal voltage and an actual substrate potential, a substrate potential detection signal produce. As a result, it is impossible for the JPA 4-38,791 to change the substrate potential $V_{SUB}$ in response to the power-supply voltage Vcc. This is because the substrate potential $V_{SUB}$ is maintained constant although the power-supply voltage Vcc varies.

Figure 5:
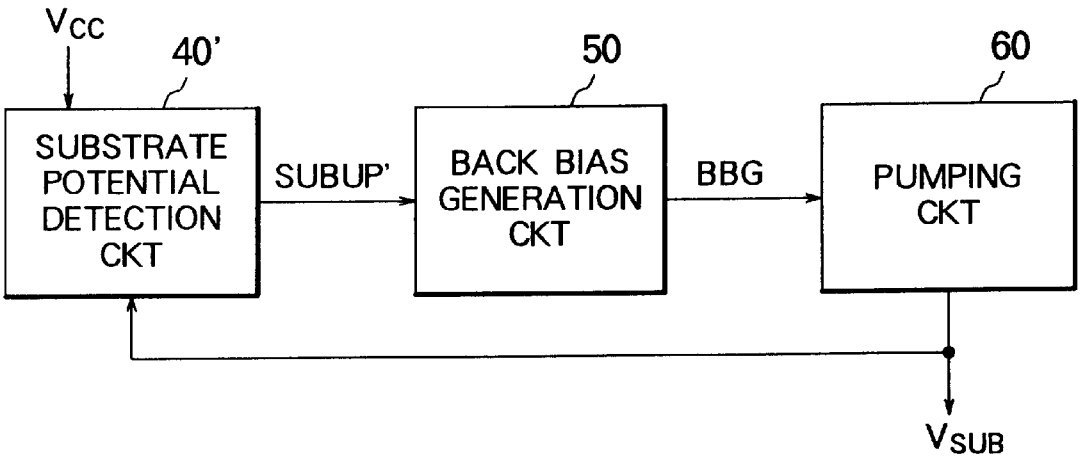
FIG. 5 PRIOR ART
FIG. 5 is a block diagram of a conventional substrate potential control circuit.

Referring to FIG. 5, a conventional substrate potential control circuit will be described to facilitate an understanding of the this invention. The illustrated substrate potential control circuit can produce, in response to the power-supply voltage Vcc, the substrate potential $V_{SUB}$ change. The illustrated substrate potential control circuit comprises a substrate potential detection circuit 40', a back bias generation circuit 50, and a pumping circuit 60.

The substrate potential detection circuit 40' detects the substrate potential $V_{SUB}$ to produce a substrate potential detection signal SUBUP'. When the substrate potential $V_{SUB}$ becomes shallow, the substrate potential detection circuit 40' produces the substrate potential detection signal SUBUP' having a logical level of "H". When the substrate potential $V_{SUB}$ becomes deep, the substrate potential detection circuit 40' produces the substrate potential detection signal SUBUP' having a logical level of "L".

The back bias generation circuit 50 comprises a ring oscillation circuit (not shown) which is described below. Supplied with the substrate potential detection signal SUBUP' having the logical level of "H", the ring oscillation circuit is activated and the back bias generation circuit 50 generates a back bias pulse signal BBG having a constant period. When the substrate potential detection signal SUBUP' has the logical level of "L", the ring oscillation circuit is not activated and the back bias generation circuit 50 generates no back bias pulse signal BBG. Responsive to the the back bias pulse signal BBG, the pumping circuit 60 operates to make the substrate potential VSUB deep by pumping. This combination of the back bias generation circuit 50 and the pumping circuit 60 serves as a substrate potential generation circuit for generating the substrate potential $V_{SUB}$ in response to the substrate potential detection signal SUBUP'.

Figure 6:
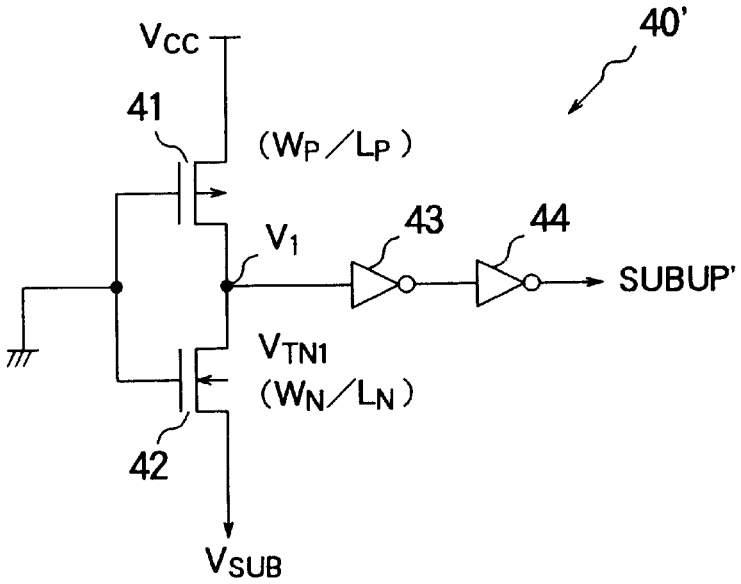
FIG. 6 PRIOR ART
FIG. 6 is a circuit diagram of a substrate potential detection circuit for use in the conventional substrate potential control circuit illustrated in FIG. 5.

Turning to FIG. 6, the substrate potential detection circuit 40' comprises a P-channel MOSFET 41, an N-channel MOSFET 42, and a driving circuit which comprises a two-stage of inverters 43 and 44. The P-channel MOSFET 41 has a gate length (channel length) $L_P$ and a gate width (channel width) $W_P$. The N-channel MOSFET 42 has a gate length (channel length) $L_N$ and a gate width (channel width) $W_N$. The N-channel MOSFET 42 has a threshold voltage $V_{TN1}$ which is approximately equal to 0.7 volts. The P-channel MOSFET 41 has a source electrode supplied with the power-supply voltage Vcc and a gate electrode which is grounded. The N-channel MOSFET 42 has a source electrode supplied with the substrate potential $V_{SUB}$ and a gate electrode which is grounded. The P-channel MOSFET 41 and the N-channel MOSFET 42 have drain electrodes which are connected to each other at a node (output point) $V_1$. The node is connected to the driving circuit.

When the substrate potential $V_{SUB}$ is deep, the N-channel MOSFET is put into an on-state and then the output point $V_1$ becomes a low potential. As a result, the substrate potential detection circuit 40' produces the substrate potential detection signal SUBUP' having the logical level of "L".

When the substrate potential $V_{SUB}$ is shallow, the N-channel MOSFET is put into an off-state and then the output point $V_1$ is charged by the P-channel MOSFET 41 to become a high potential. As a result, the substrate potential detection circuit 40' produces the substrate potential detection signal SUBUP' having the logical level of "H".

Figure 7:
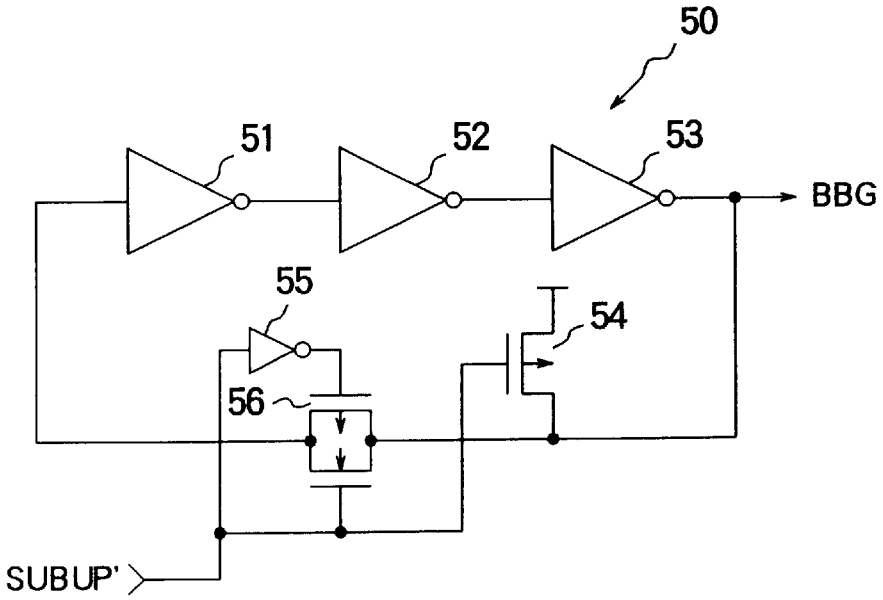
FIG. 7 PRIOR ART
FIG. 7 is a circuit diagram of a back bias generation circuit for use in the conventional substrate potential control circuit illustrated in FIG. 5.

Turning to FIG. 7, the back bias generation circuit 50 comprises the ring oscillation circuit and an oscillation control section for controlling oscillation of the ring oscillation circuit. The ring oscillation circuit comprises first through third inverters 51, 52, and 53 which are connected in cascade and which is fed back from the third inverter 53 to the first inverter 51. The oscillation control section comprises a P-channel MOSFET 54, an inverter 55, and a transfer gate 56. The transfer gate 56 is inserted in a feedback path from an output terminal of the third inverter 53 and an input terminal of the first inverter 51. The transfer gate 56 has an gate terminal which is directly supplied with the substrate potential detection signal SUBUP' and another gate terminal supplied with a signal into which the substrate potential detection signal SUBUP' is inverted by the inverter 55. The P-channel MOSFET 54 has a source electrode supplied with the power-supply voltage Vcc, a drain electrode connected to the output terminal of the third inverter 53, and a gate electrode supplied with the substrate potential detection signal SUBUP'.

Supplied with the substrate potential detection signal SUBUP' having the logical level of "H", the transfer gate is turned on and then the ring oscillation circuit is activated. Under this circumstance, the back bias generation circuit 50 generates the back bias signal BBG which repeats the logical level of "H" and the logical level of "L" at the constant period. On the other hand, when the back bias generation circuit 50 is supplied with the substrate potential detection signal SUBUP' having the logical level of "L", the ring oscillation circuit is not activated. As a result, the back bias generation circuit 50 generates no back bias signal BBC or the back bias signal BBG having the logical level of "H" which is fixed by the P-channel MOSFET 54.

Figure 8:
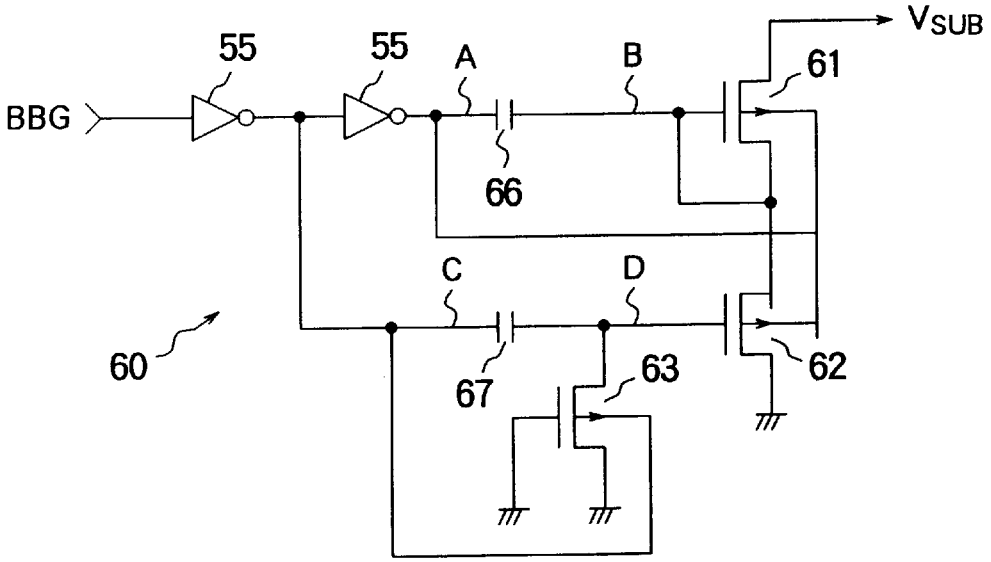
FIG. 8 PRIOR ART
FIG. 8 is a circuit diagram of a pumping circuit for use in the conventional substrate potential control circuit illustrated in FIG. 5.

Turning to FIG. 8, the pumping circuit 60 comprises three P-channel MOSFETs 61, 62, and 63, two inverters 64 and 65, and two capacitors 66 and 67. The P-channel MOSFET 61 has a drain electrode connected to a substrate (not shown) of a memory circuit (not shown), and source and gate electrodes which are connected to each other and which are connected to drain electrode of the P-channel MOSFET 62. The P-channel MOSFET 62 has a source electrode which is grounded. The P-channel MOSFET 62 has a gate electrode which is supplied with the back bias signal BBG via the inverter 64 and the capacitor 67. The P-channel MOSFET 61 has a gate electrode which is supplied with the back bias signal BBG via the inverters 64 and 65 and the capacitor 66. The P-channel MOSFETs 61 and 62 have substrate electrodes which are connected to an output terminal of the inverter 65 in common. The P-channel MOSFET 63 has a drain electrode connected to the gate electrode of the P-channel MOSFET 62, gate and source electrodes which are grounded, and a substrate electrode connected to an output terminal of the inverter 64.

As shown in FIG. 8, an output signal of the inverter 65, a signal supplied to the gate electrode of the P-channel MOSFET 61, an output signal of the inverter 64, and a signal supplied to the gate electrode of the P-channel MOSFET 62 are depicted at A, B, C, and D, respectively.

Referring to FIGS. 9A through 9E in addition to FIG. 8, description will proceed to operation of the pumping circuit 60. FIG. 9A shows a wave-form of the signal A. FIG. 9B shows a wave-form of the signal B. FIG. 9C shows a wave-form of the signal C. FIG. 9D shows a wave-form of the signal D. FIG. 9E shows a wave-form of the substrate potential $V_{SUB}$.

In the manner which is described above, the back bias signal BBG is a signal which repeats the logical level of "H" and the logical level of "L" at a constant period. When the signal A has the logical level of "H", the signal B becomes the logical level of "H" instantaneously. Inasmuch as the signals C and D have the logical level of "L" and the P-channel MOSFET 62 is turned on, the signal B gradually shifts toward the logical level of "L". When the signal A is turned to the logical level of "L", the signal B shifts toward the logical level of "L" to become a negative potential due to capacitive coupling of a shifted amount. Then, the P-channel MOSFET 61 is turned on and the substrate potential $V_{SUB}$ becomes a negative potential. At this time, the signal C is turned to the logical level of "H" and the signal D becomes the logical level of "H" instantaneously, but the signal D gradually shifts toward the logical level of "L" by the P-channel MOSFET 63.

When the signal A is turned to the logical level of "H" again, the signal B becomes the logical level of "H" and the P-channel MOSFET 61 is turned off. Conversely, the signal C becomes the logical level of "L" and the signal D shifts toward the logical level of "L", becoming a negative potential due to capacitive coupling of a shifted amount. And then the P-channel MOSFET 62 is turned on and the level of the signal B is pulled toward a ground level.

The above-mentioned process is repeatedly carried out and the substrate potential $V_{SUB}$ approaches −Vcc.

When the back bias signal BBG is not supplied to the pumping circuit 60 or the back bias signal BBG maintains the logical level of "H", the P-channel MOSFET 61 is put into an off-state and then the pumping circuit 60 does not carry out the above-mentioned pumping operation.

FIG. 10 shows a characteristic of Vcc versus $V_{SUB}$ detection level in the substrate potential control circuit illustrated in FIG. 5. In FIG. 10, the abscissa and the ordinate represent the power-supply voltage Vcc and $V_{SUB}$ detection level, respectively. The characteristic of Vcc versus $V_{SUB}$ detection level indicates a boundary at which the substrate potential detection signal SUBUP' (depicted in FIG. 6 ) becomes the logical level of "H" or the logical level of "L". In FIG. 10, a characteristic curve of $C_{SUBUP'}$ denoted by a solid line, is represented by approximately a straight line. An upper right-hand region of the characteristic curve $C_{SUBUP'}$ indicates a region where the substrate potential detection signal SUBUP' takes the logical level of "H" while a lower left-hand region of the characteristic curve $C_{SUBUP'}$ indicates a region where the substrate potential detection signal SUBUP' takes the logical level of "L". As is apparent from FIG. 10, it is known that a connection between the power-supply voltage Vcc and the $V_{SUB}$ detection level is approximately linear along the characteristic curve $C_{SUBUP'}$. As a result, inasmuch as an actual substrate potential $V_{SUB}$ is controlled by the $V_{SUB}$ detection level, the actual substrate potential $V_{SUB}$ has a value which nearly corresponds to the $V_{SUB}$ detection level illustrated in FIG. 10.

As described above, in the conventional substrate potential control circuit, the substrate potential detection section comprises only one substrate potential detection circuit 40'.

As the connection between the power-supply voltage Vcc and the substrate potential detection level is approximately linear in the conventional substrate potential control circuit, the substrate potential detection level is adjusted so as to optimize the circuit operation as a function of the substrate potential $V_{SUB}$ where the power-supply voltage Vcc rises up to a maximum level (in the specification limitations) and another level of the substrate potential $V_{SUB}$ where the power-supply voltage Vcc falls down to a minimum level (in the specification limitations).

When the power-supply voltage Vcc has the minimum level, the substrate potential $V_{SUB}$ is established to be made shallow by the substrate potential detection circuit. The purpose is to attempt to inprove performance of the N-channel MOSFET in order to expand the operation margin of the sense amplifier. Under these circumstances, the substrate potential $V_{SUB}$, where the power-supply voltage has the maximum level, also becomes shallow by an equivalent amount. However, the substrate potential $V_{SUB}$ where the power-supply voltage has the maximum level must be maintain the present condition. This is because it causes an obstacle in circuit operation if the substrate potential $V_{SUB}$, where the power-supply voltage has the maximum level, becomes shallow.

In other words, the conventional substrate potential control circuit cannot control so as to make the substrate potential $V_{SUB}$ shallow when the power-supply voltage has the minimum level and to maintain the substrate potential $V_{SUB}$ when the power-supply voltage has the maximum level.

Figure 11:
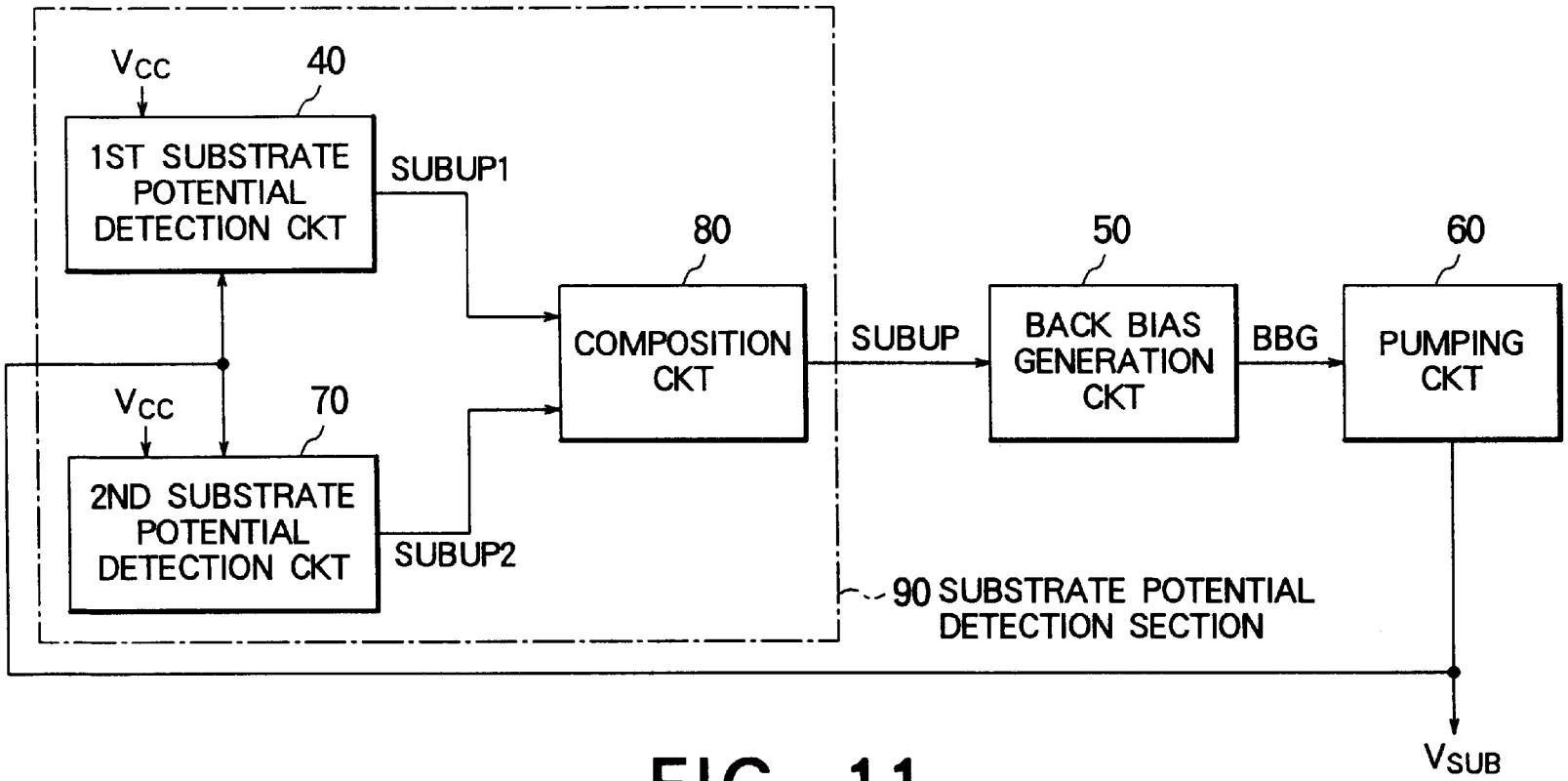
FIG. 11 is a block diagram of a substrate potential control circuit according to an embodiment of this invention.

Referring to FIG. 11, the description will proceed to a substrate potential control circuit according to one embodiment of the present invention. The illustrated substrate potential control circuit includes two substrate potential detection circuit. That is, the illustrated substrate potential control circuit comprises a first substrate potential detection circuit 40, the back bias generation circuit 50, the pumping circuit 60, a second substrate potential detection circuit 70, and a composition circuit 80. A combination of the first substrate potential detection circuit 40, the second potential detection circuit 70, and the composition circuit 80 composes a substrate potential detection section 90. Inasmuch as the back bias generation circuit 50 and the pumping circuit 60 are similar in structure and in operation to those illustrated in FIG. 5, description thereof is omitted.

The first substrate potential detection circuit 40 is supplied with the power-supply voltage Vcc. The first substrate potential detection circuit 40 detects the substrate potential $V_{SUB}$ to produce a first substrate potential detection signal SUBUP1. Likewise, the second substrate potential detection circuit 70 is supplied with the power-supply voltage Vcc. The second substrate potential detection circuit 70 detects the substrate potential $V_{SUB}$ to produce a second substrate potential detection signal SUBUP2. In the manner which will later be described, the first and the second substrate potential detection circuits 40 and 70 have different characteristics of Vcc versus $V_{SUB}$ detection level. The composition circuit 80 composes the first substrate potential detection signal SUBUP1 and the second substrate potential detection signal SUBUP2 to generate a composite substrate potential detection signal SUBUP.

Figure 12:
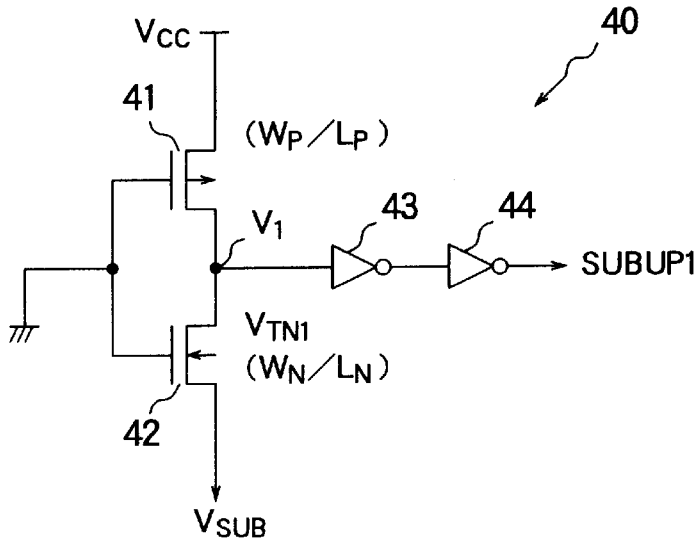
FIG. 12 is circuit diagram of a first substrate potential detection circuit for use in the substrate potential control circuit illustrated in FIG. 11.

As shown in FIG. 12, the first substrate potential detection circuit 40 is similar in structure to the substrate potential detection circuit 40' illustrated in FIG. 6. That is, the first substrate potential detection circuit 40 produces the first substrate potential detection signal SUBUP1 which is identical with the substrate potential detection signal SUBUP'. To put it simply, the first substrate potential detection circuit 40 comprises a first P-channel MOSFET 41, a first N-channel MOSFET 42, and a first driving circuit which comprises the two-stage of inverters 43 and 44. The first P-channel MOSFET 41 and the first N-channel MOSFET 42 have drain electrodes which are connected to each other at a first node (first output point) $V_1$. Detailed description of those components are already made in conjunction with FIG. 6 and then omitted.

An operation of the first substrate potential detection circuit 40 will be described below. It is assumed that the substrate potential $V_{SUB}$ is deep. In this event, the first N-channel MOSFET 42 is put into an on-state and then the first output point $V_1$ becomes a low potential. As a result, the first substrate potential detection circuit 40 produces the first substrate potential detection signal SUBUP1 having the logical level of "L". It is assumed that the substrate potential $V_{SUB}$ is shallow. In this event, the first N-channel MOSFET 42 is put into an off-state and then the first output point $V_1$ is charged via the first P-channel MOSFET 41 to become a high potential. As a result, the first substrate potential detection circuit 40 produces the first substrate potential detection signal SUBUP1 having the logical level of "H".

Figure 13:
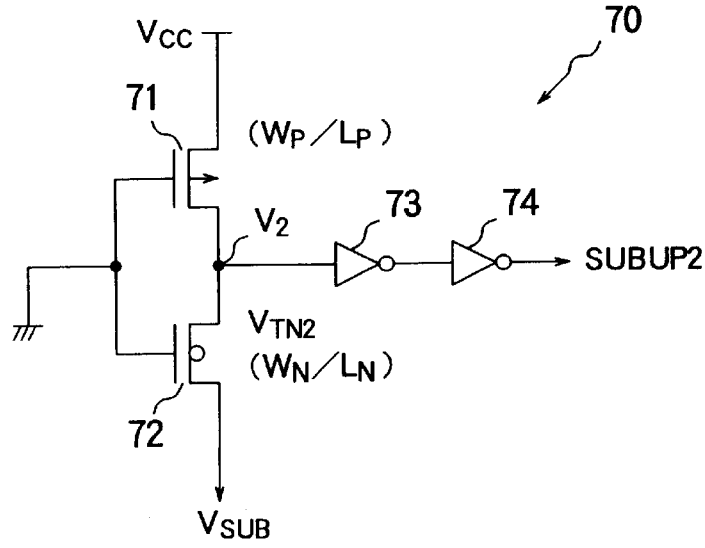
FIG. 13 is circuit diagram of a second substrate potential detection circuit for use in the substrate potential control circuit illustrated in FIG. 11.
Figure 14:
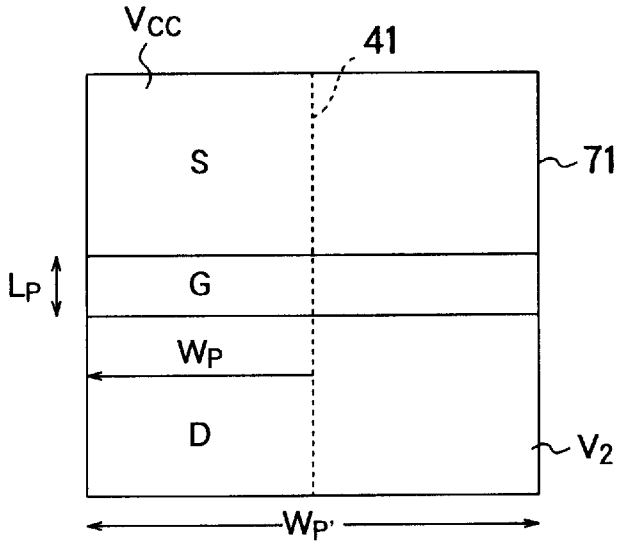
FIG. 14 is a plan view of a P-channel MOSFET illustrated in FIG. 13 in comparison with a P-channel MOSET illustrated in FIG. 12.

Turning to FIG. 13, the second substrate potential detection circuit 70 comprises a second P-channel MOSFET 71, a second N-channel MOSFET 72, and a second driving circuit which comprises the two-stage of inverters 73 and 74. As shown in FIG. 14, the second P-channel MOSFET 71 has a gate length (channel length) $L_P$ and a gate width (channel width) $W_P'$. The gate width $W_P'$ is wider than the gate $W_P$. Accordingly, the second P-channel MOSFET 71 has a larger capability than that of the first P-channel MOSFET 41 illustrated in FIG. 12. The second N-channel MOSFET 72 has a gate length (channel length) $L_N$ and a gate width (channel width) $W_N$. The second N-channel MOSFET 72 has a threshold voltage $V_{TN2}$ which is laid between 0.45 volts and 0.55 volts. Accordingly, the second N-channel MOSFET 72 has a larger capability than that of the first N-channel MOSFET 42 illustrated in FIG. 12.

The second P-channel MOSFET 71 has a source electrode supplied with power-supply voltage Vcc and a gate electrode which is grounded. The N-channel MOSFET 72 has a source electrode supplied with the substrate potential $V_{SUB}$ and a gate electrode which is grounded. The second P-channel MOSFET 71 and the second N-channel MOSFET 72 have drain electrodes which are connected to each other at a second node (second output point) $V_2$. The second node $V_2$ is connected to the second driving circuit.

An operation of the second substrate potential detection circuit 70 will be described below. It is assumed that the substrate potential $V_{SUB}$ is deep. In this event, the second N-channel MOSFET 72 is put into an on-state and then the second output point $V_2$ becomes a low potential. As a result, the second substrate potential detection circuit 70 produces the second substrate potential detection signal SUBUP2 having the logical level of "L". It is assumed that the substrate potential $V_{SUB}$ is shallow. In this event, the second N-channel MOSFET 72 is put into an off-state and then the second output point $V_2$ is charged via the second P-channel MOSFET 71 to become a high potential. As a result, the second substrate potential detection circuit 70 produces the second substrate potential detection signal SUBUP2 having the logical level of "H".

Figure 15:
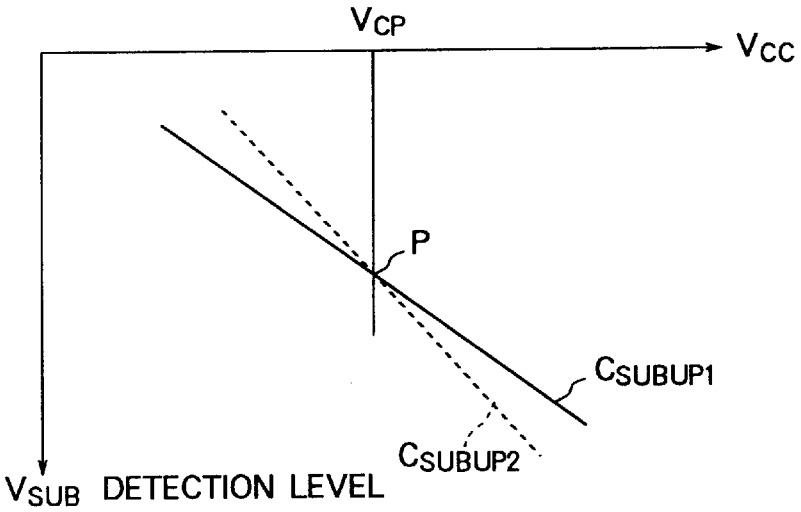
FIG. 15 shows characteristics of Vcc versus $V_{SUB}$ detection level in the substrate potential control circuit illustrated in FIG. 11.

FIG. 15 shows characteristics of Vcc versus $V_{SUB}$ detection level in the substrate potential control circuit illustrated in FIG. 11 in both of a case where the substrate potential detection section 90 tentatively comprises the first substrate potential detection circuit 40 alone (that is, the composite substrate potential detection signal SUBUP is equal to the first substrate potential detection signal SUBUP1) and another case where the substrate potential detection section 90 tentatively comprises the second substrate potential detection circuit 70 alone (that is, the composite substrate potential detection signal SUBUP is equal to the second substrate potential detection signal SUBUP2). In FIG. 15, the abscissa and the ordinate represent the power-supply voltage Vcc and $V_{SUB}$ detection level, respectively.

In FIG. 15, a solid line indicates a first characteristic curve $C_{SUBUP1}$ in a case where the composite substrate potential detection signal SUBUP is equal to the first substrate potential detection signal SUBUP1. A broken line indicates a second characteristic curve $C_{SUBUP2}$ in another case where the composite substrate potential detection signal SUBUP is equal to the second substrate potential detection signal SUBUP2. The first characteristic curve $C_{SUBUP1}$ is identical with the characteristic curve $C_{SUBUP}$ illustrated in FIG. 6 and is represented by approximately a straight line. On the other hand, the second characteristic curve $C_{SUBUP2}$ is represented by approximately another straight line which has a steeper grade than that of the first characteristic curve $C_{SUBUP1}$. The second characteristic curve $C_{SUBUP2}$ is determined so that the second characteristic curve $C_{SUBUP2}$ intersects the first characteristic curve $C_{SUBUP1}$ at a point P where the power-supply voltage Vcc is equal to a predetermined voltage Vcp.

In the first characteristic curve $C_{SUBUP1}$, an upper right-hand region of the first characteristic curve $C_{SUBUP1}$ indicates a region where the first substrate potential detection signal SUBUP1 takes the logical level of "H" while a lower left-hand region of the first characteristic curve $C_{SUBUP1}$ indicates a region where the first substrate potential detection signal SUBUP1 takes the logical level of "L". Similarly, in the second characteristic curve $C_{SUBUP2}$, an upper right-hand region of the second characteristic curve $C_{SUBUP2}$ indicates a region where the second substrate potential detection signal SUBUP2 takes the logical level of "H" while a lower left-hand region of the second characteristic curve $C_{SUBUP2}$ indicates a region where the second substrate potential detection signal SUBUP2 takes the logical level of "L".

Figure 16:
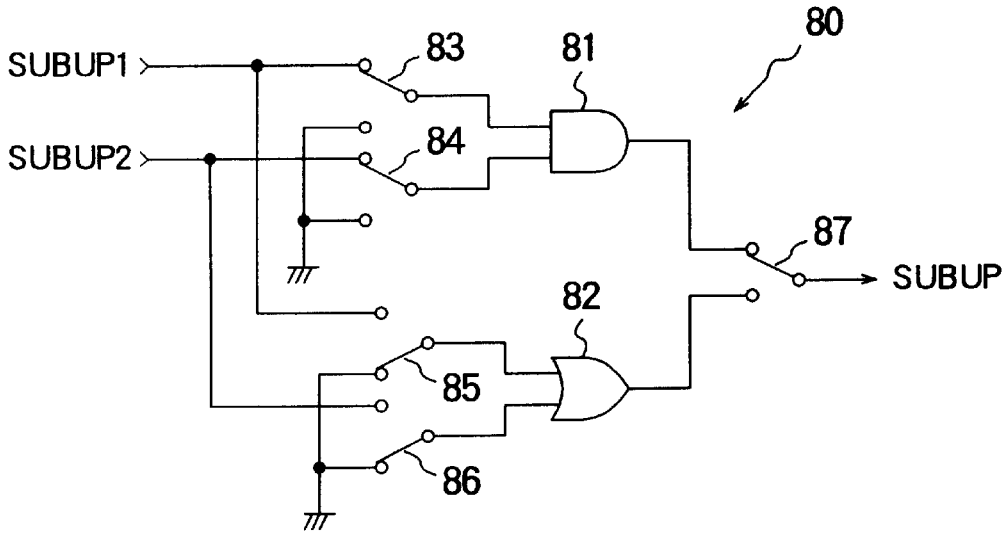
FIG. 16 is a circuit diagram of a composition circuit for use in the substrate potential control circuit illustrated in FIG. 11.

Referring to FIG. 16, the composition circuit 80 comprises an AND circuit 81, an OR circuit 82, and first through fifth switch circuits 83, 84, 85, 86, and 87. The first through the fifth switch circuits 83 to 87 collectively act as a selection arrangement for selecting one of the AND circuit 81 and the OR circuit 82. That is, the composition circuit 80 is operable at a mode selected from an AND mode and an OR mode. FIG. 16 shows a state in a case where the AND mode is selected.

It is assumed that the composition circuit 80 is operable at the AND mode as shown in FIG. 16. In this event, the first and the second switch circuits 83 and 84 select the first and the second substrate potential detection signals SUBUP1 and SUBUP2 to supply the first and the second substrate potential detection signals SUBUP1 and SUBUP2 to the AND circuit 81, respectively. Under the circumstances, the third and the fourth switch circuits 85 and 86 select a ground terminal to always supply signals having a logical level of "L" to the OR circuit 82. The fifth switch circuit 87 selects an output of the AND circuit 81. As such, when the composition circuit 80 is operable as the AND mode, the composition circuit 80 serves as the AND circuit 81 for ANDing the first substrate potential detection signal SUBUP1 and the second substrate potential detection signal SUBUP2 to produce, as the composite substrate potential detection signal SUBUP, a signal indicative of an ANDed result.

It is assumed that the composition circuit 80 is operable at the OR mode. In this event, the first and the second switch circuits 83 and 84 select the ground terminal to always supply signals having a logical level of "L" to the AND circuit 81. In addition, the third and the fourth switch circuits 85 and 86 select the first and the second substrate potential detection signals SUBUP1 and SUBUP2 to supply the first and the second substrate potential detection signals SUBUP1 and SUBUP2 to the OR circuit 82, respectively. The fifth switch circuit 87 selects an output of the OR circuit 82. As such, when the composition circuit 80 is operable as the OR mode, the composition circuit 80 serves as the OR circuit 82 for ORing the first substrate potential detection signal SUBUP1 and the second substrate potential detection signal SUBUP2 to produce, as the composite substrate potential detection signal SUBUP, a signal indicative of an ORed result.

Figure 17:
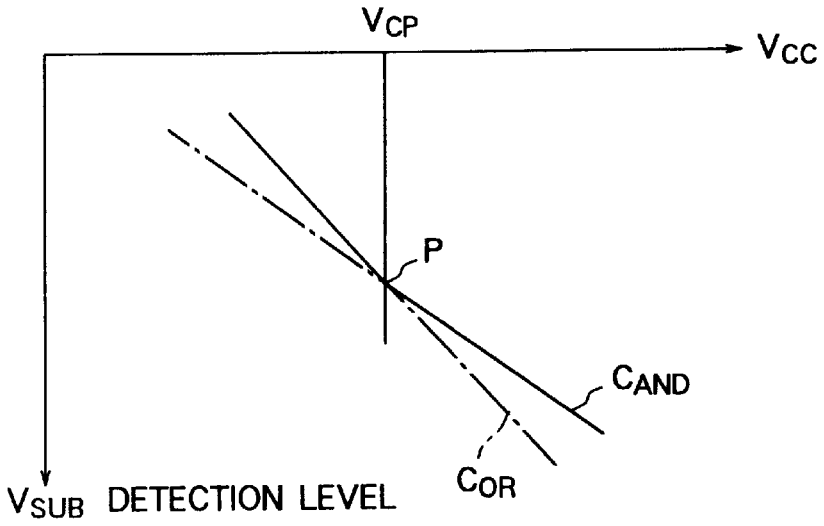
FIG. 17 shows characteristics of Vcc versus $V_{SUB}$ detection level in the substrate potential control circuit illustrated in FIG. 11, in a case where the composition circuit illustrate in FIG. 16 is operable at an AND mode and another case where the composition circuit is operable at an OR mode.

FIG. 17 shows characteristics of Vcc versus $V_{SUB}$ detection level in the substrate potential control circuit illustrated in FIG. 10 in both of a case where the composition circuit 80 is operable at the AND mode (that is, the composition circuit 80 consists of the AND circuit 81 alone) and another case where the composition circuit 80 is operable at the OR mode (that is, the composition circuit 80 consists of the OR circuit 82). In FIG. 17, the abscissa and the ordinate represent the power-supply voltage Vcc and $V_{SUB}$ detection level, respectively.

In FIG. 17, a solid line indicates an AND characteristic curve $C_{AND}$ where the composition circuit 80 is the AND circuit 81 while a chain line indicates an OR characteristic curve $C_{OR}$ where the composition circuit 80 is the OR circuit 82. In each of the AND characteristic curve $C_{AND}$ and the OR characteristic curve $C_{OR}$, an upper right-hand region thereof indicates a region where the composite substrate potential detection signal SUBUP takes the logical level of "H" while a lower left-hand region thereof indicates a region where the composite substrate potential detection signal SUBUP takes the logical level of "L".

The AND characteristic curve $C_{AND}$ is a curve for ANDing the first characteristic curve $C_{SUBUP1}$ and the second characteristic curve $C_{SUBUP2}$. More specifically, as a boundary the intersection P between the first characteristic curve $C_{SUBUP1}$ and the second characteristic curve $C_{SUBUP2}$ the AND characteristic curve $C_{AND}$ is divided into first and second partial curves in which the first partial curve goes along the first characteristic curve $C_{SUBUP1}$ when the power-supply voltage Vcc is higher than the predetermined voltage Vcp and the second partial curve goes the second characteristic curve $C_{SUBUP2}$ when the power-supply voltage Vcc is lower than the predetermined voltage Vcp. As a result, the AND characteristic curve $C_{AND}$ has a steep grade in a region where the power-supply voltage Vcc is low. Accordingly, it is possible to set the substrate voltage $V_{SUB}$ in the direction of becoming shallow in comparison with the conventional substrate potential control circuit when the power-supply voltage Vcc is low. By using the substrate potential control circuit having such as am AND characteristic curve $C_{AND}$, it is possible to lower the threshold voltage $V_{TN}$ in the N-channel MOSFET 22 (FIG. 1) and the MOSFETs in the sense amplifier SA (FIG. 1) which affect operation margin of the sense amplifier SA when the signal having the logical level of "H" is stored in the memory cell 20 (FIG. 1) with the power-supply voltage Vcc lowered to the voltage of the specification limitation. Accordingly, it is possible to improve the capability of the N-channel MOSFET 22 in the memory cell 22. In addition, the substrate potential control circuit having the AND characteristic curve $C_{AND}$ sets the substrate voltage $V_{SUB}$ in a similar manner as the conventional substrate potential control circuit when the power-supply voltage Vcc is high.

The OR characteristic curve $C_{OR}$ is a curve for ORing the first characteristic curve $C_{SUBUP1}$ and the second characteristic curve $C_{SUBUP2}$. More specifically, as the boundary the intersection P between the first characteristic curve $C_{SUBUP1}$ and the second characteristic curve $C_{SUBUP2}$, the OR characteristic curve $C_{OR}$ is divided into first and second partial curves in which the first partial curve goes along the second characteristic curve $C_{SUBUP2}$ when the power-supply voltage Vcc is higher than the predetermined voltage Vcp and the second partial curve goes along the first characteristic curve $C_{SUBUP1}$ when the power-supply voltage Vcc is lower than the predetermined voltage Vcp. As a result, the OR characteristic curve $C_{OR}$ has a steep grade in a region where the power-supply voltage Vcc is low. Accordingly, it is possible to set the substrate voltage $V_{SUB}$ in the direction of becoming deep in comparison with the conventional substrate potential control circuit when the power-supply voltage Vcc is high.

While this invention has thus far been described in conjunction with a preferred embodiment thereof, it will now be readily possible for those skilled in the art to put this invention into various other manners. For example, the substrate potential detection section may comprise the substrate potential detection circuits which are in number equal to or more three. In addition, the composition circuit is not limited to one illustrated in FIG. 16, the composition circuit may comprise the AND circuit alone or the OR circuit. The composition circuit may comprise other logical circuits. At any rate, it is possible to design the composition circuit so as to satisfy a desired characteristic of Vcc-$V_{SUB}$ detection level according to the number of the substrate potential detection circuits.

What is claimed is:

1. A semiconductor integrated circuit device comprising a substrate potential detection section supplied with a power-supply voltage for detecting a substrate potential to produce a substrate potential detection signal and a substrate potential generation circuit for generating the substrate potential in response to the substrate potential detection signal, wherein said substrate potential detection section comprises a plurality of different substrate potential detection circuits having different power-supply voltage versus substrate potential characteristics for generating a plurality of different substrate detection signals and composition means for composing the plurality of different substrate detection signals to generate a composite substrate potential detection signal, wherein said composition means comprises a logical circuit for combining the plurality of different substrate detection signals to output a logical output and an OR circuit for Oring the plurality of different substrate detection signals to produce an Ored signal and selection means for selecting one of the logical output and the Ored signal as the composite substrate detection signal.

2. A semiconductor integrated circuit device comprising a substrate potential detection section supplied with a power-supply voltage for detecting a substrate potential to produce a substrate potential detection signal and a substrate potential generation circuit for generating the substrate potential in response to the substrate potential detection signal, wherein said substrate potential detection section comprises a plurality of different substrate potential detection circuits having different power-supply voltage versus substrate potential characteristics for generating a plurality of different substate detection signals and composition means for composing the plurality of different substrate detection signals to generate a composite substrate potential detection signal, wherein said composition means comprises an AND circuit for ANDing the plurality of different substrate detection signals to produce an ANDed signal, an OR circuit for Oring the plurality of different substrate detection signals to produce an Ored signal, and selection means for selecting one of the ANDed signal and the Ored signal as a selected signal, said selection means producing the selected signal as the composite substrate potential detection signal.

3. A semiconductor integrated circuit device comprising a substrate potential detection section supplied with a power-supply voltage for detecting a substrate potential to produce a substrate potential detection signal and a substrate potential generation circuit for generating the substrate potential in response to the substrate potential detection signal, wherein said substrate potential detection section comprises first and second substrate potential detection circuits having different power-supply voltage versus substrate potential characteristics for generating a plurality of different substrate detection signals and composition means for composing the plurality of different substrate detection signals to generate a composite substrate potential detection signal, wherein said first substrate potential detection circuit comprises a first P-channel MOSFET and a first N-channel MOSFET which have drain electrodes connected to each other as a first output node, said first P-channel MOSFET and said first N-channel MOSFET having gate electrodes connected to each other, said first P-channel MOSFET having a source electrode supplied with the power-supply voltage, said first N-channel MOSFET having a source electrode supplied with the substrate potential, said second substrate potential detection circuit comprises a second P-channel MOSFET and a second N-channel MOSFET which have drain electrodes connected to each other as a second output node, said second P-channel MOSFET and said second N-channel MOSFET having gate electrodes connected to each other, said second P-channel MOSFET having a source electrode supplied with the power-supply voltage, said second N-channel MOSFET having a source electrode supplied with the substrate potential, said second P-channel MOSFET having a wider channel width than that of said first P-channel MOSFET, said second N-channel MOSFET having a threshold value voltage which is lower than that of said first N-channel MOSFET.

4. A semiconductor integrated circuit device comprising a substrate potential detection section supplied with a power-supply voltage for detecting a substrate potential to produce a substrate potential detection signal and a substrate potential generation circuit for generating the substrate potential in response to the substrate potential detection signal, wherein said substrate potential detection section comprises substrate potential detection means for generating a plurality of different substrate detection signals and composition means for composing the plurality of substrate detection signals to generate a composite substrate potential detection signal, wherein said composition means comprises a logical circuit for combining the plurality of different substrate detection signals to output a logical output and an OR circuit for ORing the plurality of different substrate detection signals to produce an ORed signal and selection means for selecting one of the logical output and the ORed signal as the composite substrate detection signal.

5. A semiconductor integrated circuit device as claimed in claim 4, wherein said substrate potential generation circuit comprises a back bias generation circuit for generating a back bias signal in response to the composite substrate detection signal and a pumping circuit for carrying out, in response to the back bias signal, a pumping operation so as to deepen the substrate potential.

6. A semiconductor integrated circuit device as claimed in claim 4, wherein said substrate potential detection means comprises a first substrate potential detection circuit having a first characteristic of the power supply voltage versus the substrate potential so that a detection level for the substrate potential relatively slowly changes with variation in the power supply voltage and a second substrate potential detection circuit having a second characteristic of the power-supply voltage versus the substrate potential so that a detection level for the substrate potential rapidly changes with variation in the power-supply voltage in comparison with the first characteristic.

7. A semiconductor integrated circuit device as claimed in claim 6, wherein said first substrate potential detection circuit comprises a first P-channel MOSFET and a first N-channel MOSFET which have drain electrodes connected to each other as a first output node, said first P-channel MOSFET and said first N-channel MOSFET having gate electrodes connected to each other, said first P-channel MOSFET having a source electrode supplied with the power-supply voltage, said first N-channel MOSFET having a source electrode supplied with the substrate potential, said second substrate potential detection circuit comprises a second P-channel MOSFET and a second N-channel MOSFET which have drain electrodes connected to each other as a second output node, said second P-channel MOSFET and said second N-channel MOSFET having gate electrodes connected to each other, said second P-channel MOSFET having a source electrode supplied with the power-supply voltage, said second N-channel MOSFET having a source electrode supplied with the substrate potential, said second P-channel MOSFET having a wider channel width than that of said first P-channel MOSFET, said second N-channel MOSFET having a threshold value voltage which is lower than that of said first N-channel MOSFET.

8. A semiconductor integrated circuit device comprising a substrate potential detection section supplied with a power-supply voltage for detecting a substrate potential to produce a substrate potential detection signal and a substrate potential generation circuit for generating the substrate potential in response to the substrate potential detection signal, wherein said substrate potential detection section comprises substrate potential detection means for generating a plurality of different substrate detection signals and composition means for composing the plurality of substrate detection signals to generate a composite substrate potential detection signal, wherein said composition means comprises an AND circuit for ANDing the plurality of different substrate detection signals to produce an ANDed signal, an OR circuit for ORing the plurality of different substrate detection signals to produce an ORed signal, and selection means for selecting one of the ANDed signal and the ORed signal as a selected signal, said selection means producing the selected signal as the composite substrate potential detection signal.

9. A semiconductor integrated circuit device as claimed in claim 8, wherein said substrate potential generation circuit comprises a back bias generation circuit for generating a back bias signal in response to the composite substrate detection signal and a pumping circuit for carrying out, in response to the back bias signal, a pumping operation so as to deepen the substrate potential.

10. A semiconductor integrated circuit device as claimed in claim 8, wherein said substrate potential detection means comprises a first substrate potential detection circuit having a first characteristic of the power supply voltage versus the substrate potential so that a detection level for the substrate potential relatively slowly changes with variation in the power supply voltage and a second substrate potential detection circuit having a second characteristic of the power-supply voltage versus the substrate potential so that a detection level for the substrate potential rapidly changes with variation in the power-supply voltage in comparison with the first characteristic.

11. A semiconductor integrated circuit device as claimed in claim 10, wherein said first substrate potential detection circuit comprises a first P-channel MOSFET and a first N-channel MOSFET which have drain electrodes connected to each other as a first output node, said first P-channel MOSFET and said first N-channel MOSFET having gate electrodes connected to each other, said first P-chapel MOSFET having a source electrode supplied with the power-supply voltage, said first N-channel MOSFET having a source electrode supplied with the substrate potential, said second substrate potential detection circuit comprises a second P-channel MOSFET and a second N-channel MOSFET which have drain electrodes connected to each other as a second output node, said second P-channel MOSFET and said second N-channel MOSFET having gate electrodes connected to each other, said second P-channel MOSFET having a source electrode supplied with the power-supply voltage, said N-channel MOSFET having a source electrode supplied with the substrate potential, said second P-channel MOSFET having a wider channel width than that of said first P-channel MOSFET, said second N-channel MOSFET having a threshold value voltage which is lower than that of said first N-channel MOSFET.

12. A semiconductor integrated circuit device comprising a substrate potential detection section supplied with a power-supply voltage for detecting a substrate potential to produce a substrate potential detection signal and a substrate potential generation circuit for generating the substrate potential in response to the substrate potential detection signal, wherein said substrate potential detection section comprises substrate potential detection means for generating a plurality of different substrate detection signals and composition means for composing the plurality of substrate detection signals to generate a composite substrate potential detection signal, wherein said substrate potential detection means comprises a first substrate potential detection circuit having a first characteristic of the power supply voltage versus the substrate potential so that a detection level for the substrate potential relatively slowly changes with variation in the power supply voltage and a second substrate potential detection circuit having a second characteristic of the power-supply voltage versus the substrate potential so that a detection level for the substrate potential rapidly changes with variation in the power-supply voltage in comparison with the first characteristic, and wherein said first substrate potential detection circuit comprises a first P-channel MOS- FET and a first N-channel MOSFET which have drain electrodes connected to each other as a first output node, said first P-channel MOSFET and said first N-channel MOSFET having gate electrodes connected to each other, said first P-channel MOSFET having a source electrode supplied with the power-supply voltage, said first N-channel MOSFET having a source electrode supplied with the substrate potential, and said second substrate potential detection circuit comprises a second P-channel MOSFET and a second N-channel MOSFET which have drain electrodes connected to each other as a second output node, said second P-channel MOSFET and said second N-channel MOSFET having gate electrodes connected to each other, said second P-channel MOSFET having a source electrode supplied with the power-supply voltage, said second N-channel MOSFET having a source electrode supplied with the substrate potential, said second P-channel MOSFET having a wider channel width than that of said first P-channel MOSFET, said second N-channel MOSFET having a threshold value voltage which is lower than that of said first N-channel MOSFET.

13. A semiconductor integrated circuit device as claimed in claim 12, wherein said composition means is an AND circuit for ANDing the plurality of different substrate detection signals to produce an ANDed signal as the composite substrate detection signal.

* * * * *

UNITED STATES PATENT AND TRADEMARK OFFICE

CERTIFICATE OF CORRECTION

PATENT NO. : 6,020,780
DATED : February 1, 2000
INVENTOR(S) : Seiji Ozeki

It is certified that error appears in the above-identified patent and that said Letters Patent is hereby corrected as shown below:

Column 14,
Line 7, change “substate” to -- substrate --.

Signed and Sealed this

Thirty-first Day of December, 2002

JAMES E. ROGAN
*Director of the United States Patent and Trademark Office*